US011865465B2

(12) United States Patent
Thelen

(10) Patent No.: US 11,865,465 B2
(45) Date of Patent: Jan. 9, 2024

(54) PUZZLE SYSTEM, INTERACTIVE CUBE PUZZLE GAME, INTERACTIVE ELECTRONIC PUZZLE GAME SYSTEM, AND METHODS OF USE

(71) Applicant: Eric Thelen, Budel (NL)

(72) Inventor: Eric Thelen, Budel (NL)

( * ) Notice: Subject to any disclaimer, the term of this patent is extended or adjusted under 35 U.S.C. 154(b) by 0 days.

(21) Appl. No.: 17/669,561

(22) Filed: Feb. 11, 2022

(65) Prior Publication Data

US 2022/0266126 A1 Aug. 25, 2022

Related U.S. Application Data

(60) Provisional application No. 63/151,094, filed on Feb. 19, 2021.

(51) Int. Cl.

| | |
|---|---|
| ***A63F 9/06*** | (2006.01) |
| ***A63F 9/08*** | (2006.01) |
| ***A63F 9/24*** | (2006.01) |

(52) U.S. Cl.

CPC ..... *A63F 9/0612* (2013.01); *A63F 9/0838* (2013.01); *A63F 9/24* (2013.01); *A63F 2009/2402* (2013.01); *A63F 2009/2454* (2013.01)

(58) Field of Classification Search

CPC ..... A63F 9/0612; A63F 9/0838; A63F 9/24; A63F 2009/2402; A63F 2009/2454; A63F 2009/2452

USPC ..... 463/9

See application file for complete search history.

(56) References Cited

U.S. PATENT DOCUMENTS

| | | | | |
|---|---|---|---|---|
| 4,427,197 | A * | 1/1984 | Doose | A63F 9/0842 273/153 S |
| 9,770,648 | B1 * | 9/2017 | Nelson | A63F 9/0612 |
| 10,313,834 | B1 * | 6/2019 | Knas | H04W 4/023 |
| 2013/0270768 | A1 * | 10/2013 | Carlow | A63F 11/00 273/148 R |
| 2014/0370950 | A1 * | 12/2014 | Hansson | A63F 13/00 463/9 |
| 2017/0225065 | A1 * | 8/2017 | Miller | A63F 7/0023 |
| 2018/0311566 | A1 * | 11/2018 | Shin | A63F 9/24 |
| 2019/0176024 | A1 * | 6/2019 | Hansson | A63F 13/2145 |
| 2022/0379195 | A1 * | 12/2022 | Junkka | A63F 9/0612 |

* cited by examiner

*Primary Examiner* — Pierre E Elisca

(57) ABSTRACT

The present invention relates to a novel puzzle system that includes an interactive cube puzzle game and methods of use. It provides a puzzle game concept that is implemented as a three-dimensional game or a two-dimensional game, in which a user achieves success by matching a target pattern based on manipulation of identifiable elements. It comprises a plurality of connected elements, a plurality of identifiable elements, a plurality of user interface elements and is configured to operate based on the transition of the plurality of the identifiable elements from a first position to a second position to obtain a target pattern. The transition from the first position to the second position includes variation in the plurality of the identifiable elements.

15 Claims, 4 Drawing Sheets

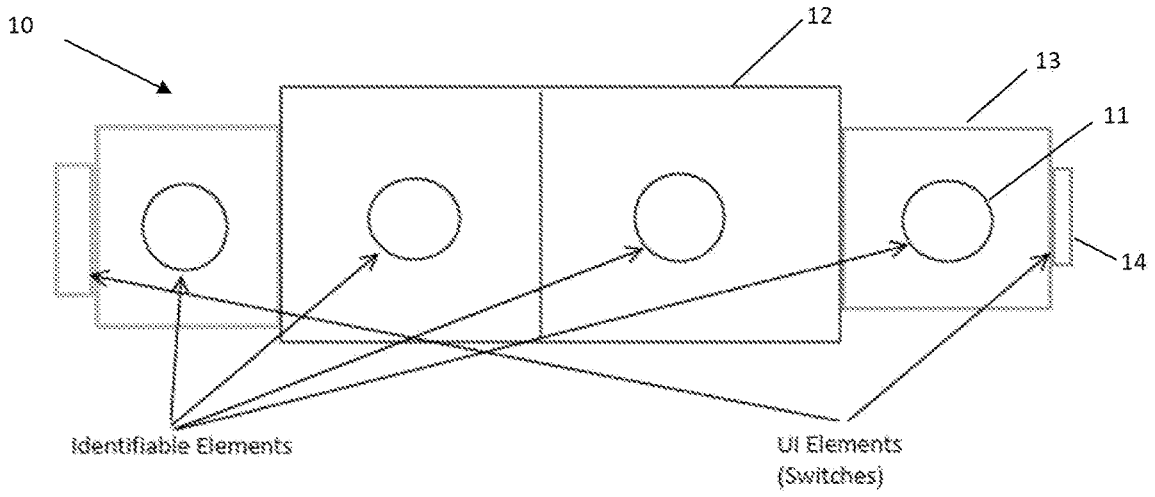
Fig. 1 [Amended]
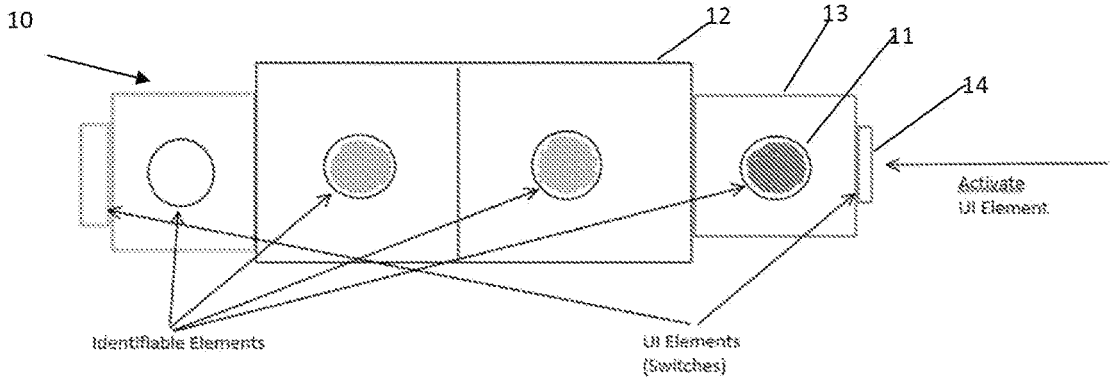
Fig. 2(a)
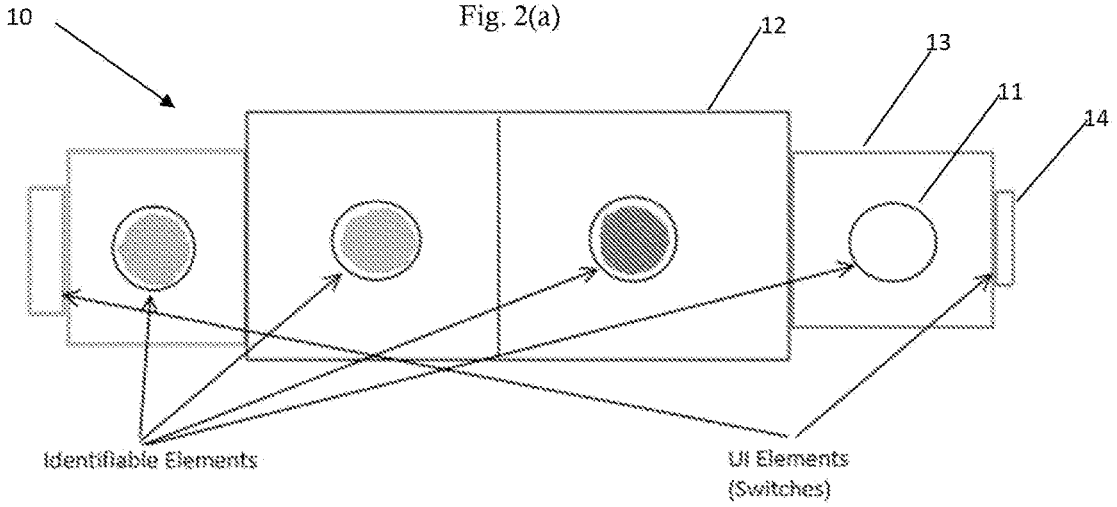
Fig. 2(b)

PUZZLE SYSTEM, INTERACTIVE CUBE PUZZLE GAME, INTERACTIVE ELECTRONIC PUZZLE GAME SYSTEM, AND METHODS OF USE

FIELD OF THE INVENTION

The present invention relates to a novel puzzle system that includes an interactive cube puzzle game and methods of use. More particularly, the present invention relates to a puzzle game concept that is implemented as a three-dimensional game or a two-dimensional game, in which a user achieves success by matching a target pattern based on manipulation of identifiable elements.

BACKGROUND OF THE INVENTION

A game is a structured form of play and often consists of a set of rules, challenges, and sometimes user and/or player interactions. Sometimes games are developed to help individuals develop certain skills, such as educational learning while some games are strictly for fun or entertainment purposes. In this way, games are often played for a sense of achievement and/or trying to achieve a goal. Games may be played alone, online, or in teams, and the like.

Puzzles are a type of game that involves a set of rules and challenges. It usually involves a type of game piece or an interaction item which a user physically interacts with, or interacts with through simulation, such as via a computer system with a display or online. The puzzles are solved through achieving a target goal which requires a lot of brain work and time. Therefore, puzzles test a person's ingenuity or knowledge or mathematical ability or logical thinking abilities.

Some more modern games and/or puzzles and/or game puzzles involve a user interface through which a user can interact with a space and/or computer system to play a computer game or to solve puzzles irrespective of the nature of the puzzles games whether those puzzles are word games such as scrabble or more complex user interface games with realistic graphics and realistic three-dimensional worlds such as games played on modern day computer systems which provide hardware and a controller that connect to a display screen. In this way, a human and/or user experiences game play through the interaction of the operation and/or control of a machine (not necessarily like a mechanical puzzle but rather through a display).

U.S. Pat. No. 4,872,682 discloses a puzzle cube with movable sliders with different levels of difficulty having at least one of the surfaces of the cubelets forming an exterior surface part of the base cube with a slider, thus defining at least one blank. Each slider can be numbered, or given an orientation such as by an arrow thereon, or all the sliders for each side of the base cube can be given a respective different color, either by being so manufactured or by means of stickers placeable on the sliders. The respective parts of the base club can also be colored and/or numbered, for instance the bands along the intersections of the exterior surfaces (faces) of the base cube, these bands extending peripherally as a frame around the collection of sliders on each face of the base cube. The main drawback of the invention is that known cubes are basically two surfaces, one within the other, which move relative to each other.

U.S. Pat. No. 4,471,959 discloses a logical toy for the arrangement in any desired pattern of numerals, figures or other symbols printed on independent game pieces. It contains one or more lower pushers and upper pushers movable perpendicularly thereto in grooves formed on a bearing plate. The number of lower and upper pushers and the number of the game pieces can be varied as desired. The game pieces can be arranged in directions perpendicular to one another by shifting the pushers. The bearing plate and the pushers are sealed in by a transparent plate, or one provided with apertures, which is attached to the bearing plate in a permanent manner. The main drawback of the invention is that the number and arrangement both of the game pieces and of the first and second pushing means is variable.

USSR I. C. No. 1452535, M. Figure US07/108263-20060919-P00001. A63F 9/08 of Nov. 3, 1986, published Jan. 23, 1989) discloses a sphere comprising game-playing elements of two types which are formed by dissecting the sphere by three planes perpendicular to the vertical axis thereof. The known three-dimensional logic puzzle game incorporates a hinging unit allowing the game-playing hemispheres to turn in the meridian plane and featuring a shroud ring with a guiding closed groove made on the interior surface. The game-playing elements adjoining the poles have projections which form, when matched, central locating cylinders to interact with the guiding groove of the shroud ring. The main drawback of the invention is its difficult fabrication and complex design.

JP 558193 discloses a total of eight cubes which form one large cube in the assembled state. This logical toy has been designed in such a manner, that one cube out of the eight cubes is fastened to a centrally positioned rotating element. One corner each of the remaining seven cubes is formed with a spherical surface. The rotation is enabled by the plate or slab shaped body following the curvature of the sphere having been fixed to the pivot protruding from the rounded curved corners of the small cubes, while the pivot itself is fixed by a threaded pin to the centrally arranged sphere. The main drawback of the invention is that it does not ensure an accurate and smooth mutual displacement, since there is a certain clearance and the plate-shaped solids get deformed, thereby limiting the number of rotations.

Therefore, there is a need for a puzzle game that can be implemented either in a physical form as a mechanical puzzle system with various interaction and changing components, which may be realized by electronics and the like, or alternatively in a purely electronic form, i.e. without a physical representation.

The present invention provides a game system that interacts with a user and/or human through human-machine interaction and/or human-computer interaction and/or composite user interfaces, a combination thereof, and the like. In view of this, the present invention provides a novel puzzle system, a novel interactive cube puzzle game, a novel interactive electronic puzzle game system, and methods of use.

OBJECT OF THE INVENTION

The main object of the present invention is to provide a novel puzzle system, a novel interactive cube puzzle game, a novel interactive electronic puzzle game system, and methods of use.

Another main object of the present invention is to provide a puzzle game concept, which can be implemented as a three-dimensional game or a two-dimensional game.

Yet another object of the present invention is to provide a puzzle game in which a user hits a target pattern through the manipulation of identifiable elements.

Yet another object of the present invention is to provide a puzzle system, an interactive cube puzzle game, an interactive electronic puzzle game system, and methods of use that can be implemented in a three-dimensional puzzle.

Yet another object of the present invention is to provide a puzzle system, an interactive cube puzzle game, an interactive electronic puzzle game system, and methods of use that provide identifiable elements that may be in the form of multi-colored light emitting diodes.

Yet another object of the present invention is to provide a puzzle system, an interactive cube puzzle game, an interactive electronic puzzle game system, and methods of use that provide game programming which can change the colors of light emitting diodes to give the appearance of moving components even in non-moving components.

Yet another object of the present invention is to provide a puzzle system, an interactive cube puzzle game, an interactive electronic puzzle game system, and methods of use that provide a plurality of switches and/or user interaction features.

Yet another object of the present invention is to provide a puzzle system, an interactive cube puzzle game, an interactive electronic puzzle game system, and methods of use that provide a plurality of intersecting sets of connected elements, each consisting of identifiable elements which can each be manipulated by a user in such a way that the identifiable elements can be moved by one element from one side to the other.

Yet another object of the present invention is to provide a puzzle system, an interactive cube puzzle game, an interactive electronic puzzle game system, and methods of use that are available on mobile devices.

Yet another object of the present invention is to provide a puzzle system, an interactive cube puzzle game, an interactive electronic puzzle game system, and methods of use that are symmetrical.

Still another object of the present invention is to provide more enjoyable, puzzle and/or user interface game and puzzle game system designed to engage users for entertainment, educational, logical challenges, mental development, motor skill and functional development, therapeutic purposes, relaxation assistance, rehabilitation functionality, and hand-eye coordination maintenance.

SUMMARY OF THE INVENTION

The present invention provides a novel puzzle system that includes an interactive cube puzzle game and methods of use. More particularly, the present invention to a puzzle game concept that is implemented as a three-dimensional game or a two-dimensional game, in which a user achieves success by hitting a target pattern based on manipulation of identifiable elements.

In a main embodiment, the present invention provides an interactive puzzle game system comprising a plurality of connected elements, a plurality of identifiable elements, a plurality of user interface elements. The plurality of connected elements is further divided into a plurality of center block elements and a plurality of side block elements. A side of the plurality of center block elements is enclosed by the plurality of side block elements. Each of the center block elements and the side block elements of the connected elements may be associated with one of the identifiable elements. The plurality of side block elements is associated with one of the user interface elements wherein the interactive puzzle system runs on various modes. The interactive puzzle game system is configured to operate based on movement of the plurality of the identifiable elements from a first position to a second position. The transition from the first position to the second position may further include a variation in the plurality of the identifiable elements.

Said interactive puzzle system has a target pattern that consists of a plurality of target locations and a target identifiable element being associated with each of the target locations. The puzzle game has been solved when a target pattern has been matched by the corresponding identifiable elements at all of the applicable target locations. The plurality of identifiable elements may be realized, without being limited to this, in the form of multi-color LEDs. The variation of the plurality of the identifiable elements is based on change in colors of LEDs. The user interface elements include but are not limited to a plurality of switches and/or buttons. The target pattern may be modified based on whether the movement of the plurality of identifiable elements exceeds a threshold value at a predefined time. The target pattern may be set by a user. The target pattern may be reset based on user's input or under a specific condition. The connected elements are arranged in a multi-dimensional array. The shape of the connected elements includes but is not limited to a square, a hexagon, an octagon, a circle, a different polygon, or other shape or the like. Some or all of the identifiable elements are either temporarily or permanently hidden, so that their status cannot be directly observed by the player.

In this way, the present invention provides multiple interactive systems and methods of use which provide a beneficial activity for children; a beneficial and/or entertaining activity for adults; a beneficial and fun activity that accelerates the mental development as well as the development of fine motor skills as well as the maintenance of brain engagement. Furthermore, and said another way, the present invention provides a system and method of use which aids in the development of creativity, logical processing, and mathematical engagement of children as well as adults, while also providing and/or causing mental stimulation in creativity and/or engagement in children and adults, alike.

BRIEF DESCRIPTION OF THE DRAWINGS

FIG. 1 shows a basic structure of a puzzle system in accordance with an embodiment of the present invention.

FIG. 2*a* shows a diagram for manipulation and movement principle of the puzzle system in accordance with an embodiment of the present invention.

FIG. 2*b* shows the basic flow of manipulation when the movement occurs in the puzzle system in accordance with an embodiment of the present invention.

Figure 3:
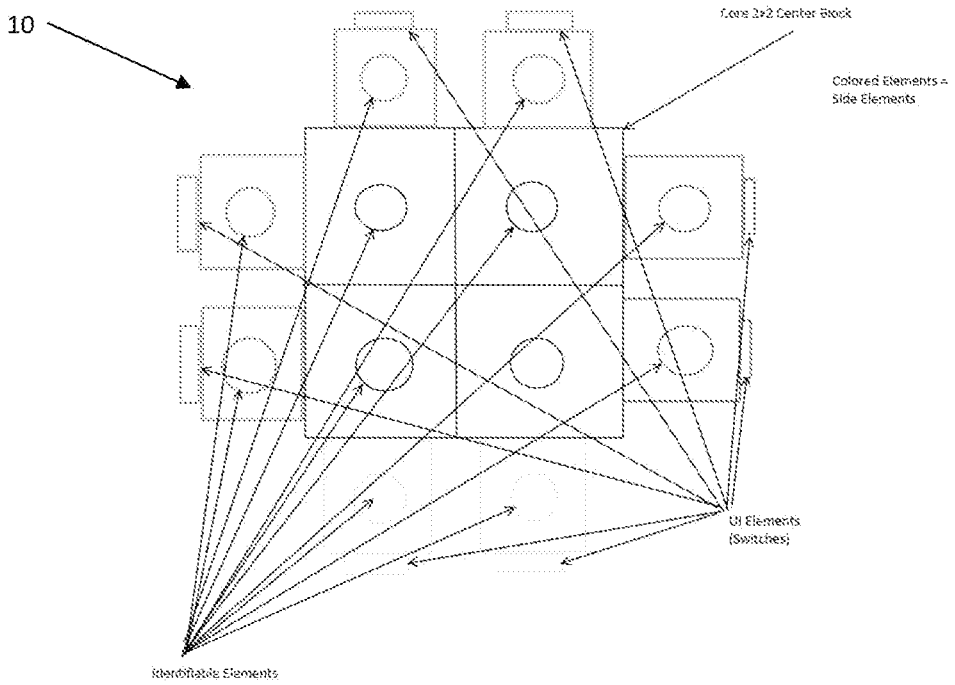
FIG. 3 shows 2×2 dimensional array of the puzzle system in accordance with an embodiment of the present invention.

The drawings accompanying and forming part of this specification are included to depict certain aspects of the present invention.

DETAILED DESCRIPTION OF THE INVENTION

In the following detailed description, reference is made to the accompanying drawings which form a part hereof, and in which is shown by way of illustration specific embodiments in which the present invention may be practiced. These embodiments are described in sufficient detail to enable those skilled in the art to practice the present invention, and it is to be understood that other embodiments may be utilized and that mechanical, procedural, and other changes may be made without departing from the spirit and scope of the present invention. The following detailed description is, therefore, not to be taken in a limiting sense, and the scope of the present invention is defined only by the appended claims, along with the full scope of equivalents to which such claims are entitled.

As used herein, the terminology such as vertical, horizontal, top, bottom, front, back, end, sides and the like are referenced according to the views, pieces and figures presented. It should be understood, however, that the terms are used only for purposes of description, and are not intended to be used as limitations. Accordingly, orientation of an object or a combination of objects may change without departing from the scope of the present invention.

Reference throughout this specification to "one embodiment," "an embodiment," "one example," or "an example" means that a particular feature, structure, or characteristic described in connection with the embodiment or example is included in at least one embodiment.

Embodiments in accordance with the present invention may be embodied as an apparatus, method, or computer program product. Accordingly, the present invention may take the form of an entirely hardware-comprised embodiment, an entirely software-comprised embodiment (including firmware, resident software, micro-code, etc.), or an embodiment combining software and hardware aspects that may all generally be referred to herein as a "circuit," "module," or "system." Furthermore, embodiments of the present invention may take the form of a computer program product embodied in any tangible medium.

Any combination of one or more computer-usable or computer-readable media may be utilized. For example, a computer-readable medium may include one or more of a portable computer diskette, a hard disk, a random-access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present invention may be written in any combination of one or more programming languages. Such code may be compiled from source code to computer-readable assembly language or machine code suitable for the device or computer on which the code will be executed.

Embodiments may also be implemented in cloud computing environments. In this description and the following claims, "cloud computing" may be defined as a model for enabling ubiquitous, convenient, on-demand network access to a shared pool of configurable computing resources (e.g., networks, servers, storage, applications, and services) that can be rapidly provisioned via virtualization and released with minimal management effort or service provider interaction and then scaled accordingly. A cloud model can be composed of various characteristics (e.g., on-demand self-service, broad network access, resource pooling).

The present invention relates to a puzzle game in which a user achieves success by matching a target pattern through the manipulation of identifiable elements.

As seen in FIG. 1, the present invention provides a puzzle system 10 that comprises a cube puzzle game concept, which can be implemented as a three-dimensional or as a two-dimensional puzzle game. The puzzle system 10 is configured to operate from a plurality of identifiable elements 11. The identifiable elements are manipulated by a user to achieve a target pattern. The identifiable elements 11 are in the form of multi-color light emitting diodes. The actual color of the multi-color light emitting diodes at any point in time are determined by the game programming. The light emitting diodes do not move while playing gameplay. The movement is caused by a user in a virtual way by game programming that changes the colors of the light emitting diodes.

The puzzle system 10 is based on a plurality of center block elements 12 which is generally cube shaped. The center block elements 12 further comprises of a plurality of side elements 13, formed of (possibly smaller) cubes thus making up a larger center cube. Each of the sides of the center block elements 12 contains the plurality of side elements 13 formed by the (possibly smaller) cubes. Each of the side elements 13 contains an identifiable element 11 which a user manipulates. Each of the side elements 13 provides a user interface element 14. A user interacts during gameplay to activate and/or deactivate and/or interface with the puzzle system 10.

The three-dimensional puzzle system 10 has at least one of six sides or is a 2×2×2 cube. However, other sizes featuring various numbers of identifiable elements are also hereby contemplated for use including a 2×2×2 cube, or a 3×3×3 cube, or a 4×4×4 cube, or a 5×5×5 cube, or a 6×6×6 cube, or a 7×7×7 cube, or an 8×8×8 cube, or a 9×9×9 cube, and more and in various shapes such as regular polyhedrons and irregular polyhedrons.

As seen in FIG. 2(*a*), where 4 elements are connected, the present invention provides a set of connected elements (12, 13), which always contains on both sides side elements that are associated with user interface (UI) elements 14 that can be activated by the player. For each set of connected elements, one of the identifiable elements 11 on one of the sides of the set of connected elements always shows the "empty" state, which can be represented by a Light Emitting Diode (LED) that is switched off (in an electronic realization of the cube concept) or by an empty slot (in a mechanical realization of the cube concept).

As seen in FIG. 2(*b*), the present invention shows that when the UI element 14 on any of the two sides of the set of connected elements (13, 14) is activated, the identifiable elements 11 move through the set of the connected elements in such a way that each identifiable element moves by one element (or by one "position"). After the move, the identifiable element that originally had the "empty" state now represents the element that had previously been next to it. The identifiable element at the other side of the set of the connected elements is now "empty". The overall effect of this movement is from the first position (FIG. 2(*a*)) to the second position (FIG. 2(*b*)). If any of the UI elements on any of the two sides of the set of connected elements is activated in the situation shown in FIG. 2(*b*), then all identifiable elements move back to the previous position as shown in FIG. 2(*a*).

FIG. 3 shows a coloring of the sides of a set of connected elements in a 2×2 2-dimensional pattern with side elements. The left side is colored green; the right side is colored red;

the upper side is colored blue; the lower side is colored yellow. The coloring of the sides indicates the target color for the identifiable element that should be moved into this position. One side shows the "solved" state for color red, while other side shows the "solved" state for color green—and so on also for colors blue and yellow.

The sets of connected elements are intersecting in the overall puzzle game, so that the identifiable elements move between the sets of connected elements and move across the entire puzzle game.

FIG. 3 shows a more complete 2-dimensional 2×2 version of the Cube concept. Here, four of the sets of connected elements are intersecting—2 horizontally and 2 vertically. There are now 12 identifiable elements and 8 UI (side) elements.

Figure 4:
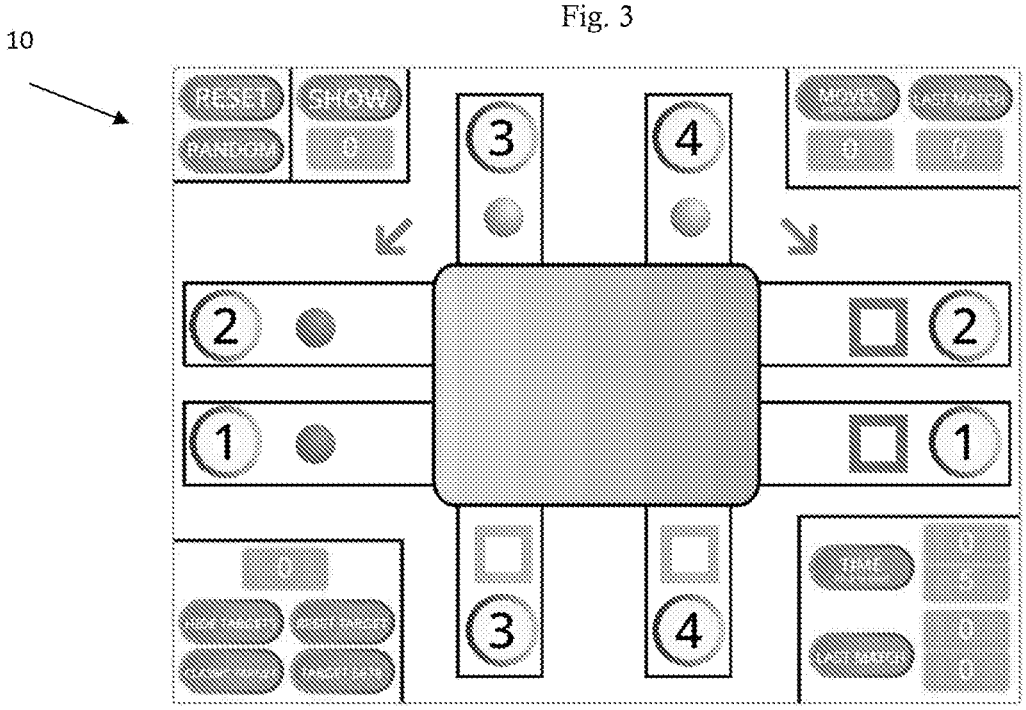
FIG. 4 shows 2×2 dimensional array cube concept of the puzzle system in accordance with an embodiment of the present invention.

In FIG. 4, which has been obtained from an interactive Scratch implementation, the overall gameplay is illustrated (and simulated) in a more complete way for a 2-dimensional 2×2 version of the Cube concept. As shown, pressing on the green flag starts the game and pressing the RESET button resets the game, pressing the SHOW button makes it possible to see all of the identifiable elements. (Hiding the identifiable elements in the centre block represents an "advanced" game mode, where the players cannot see all of the relevant information, at least not all of the time.) There are two identifiable elements each for the colors green, red, yellow and blue. (In FIG. 4, the identifiable elements for the colors yellow and blue are hidden.) Four identifiable (side) elements are (see above) always "empty".

The objective in this version of the game is to move the green identifiable elements from the top to the green target fields on the bottom and to also move the red identifiable elements from the left to the red target fields on the right. The UI elements are represented by the numbers from 1 to 4, which are clicked on the screen or pressed on the keyboard. For more complex versions of the game (e.g., 2-dimensional 3×3, 3-dimensional 2×2×2 or 3-dimensional 3×3×3, the game mechanics are still the same. The identifiable elements are moved according to the rules for manipulating specific sets of connected elements, where always one identifiable element in each set of connected elements shows the empty state. The UI elements are used to indicate which set of connected elements is manipulated for each "move" of the game.

Figure 5:
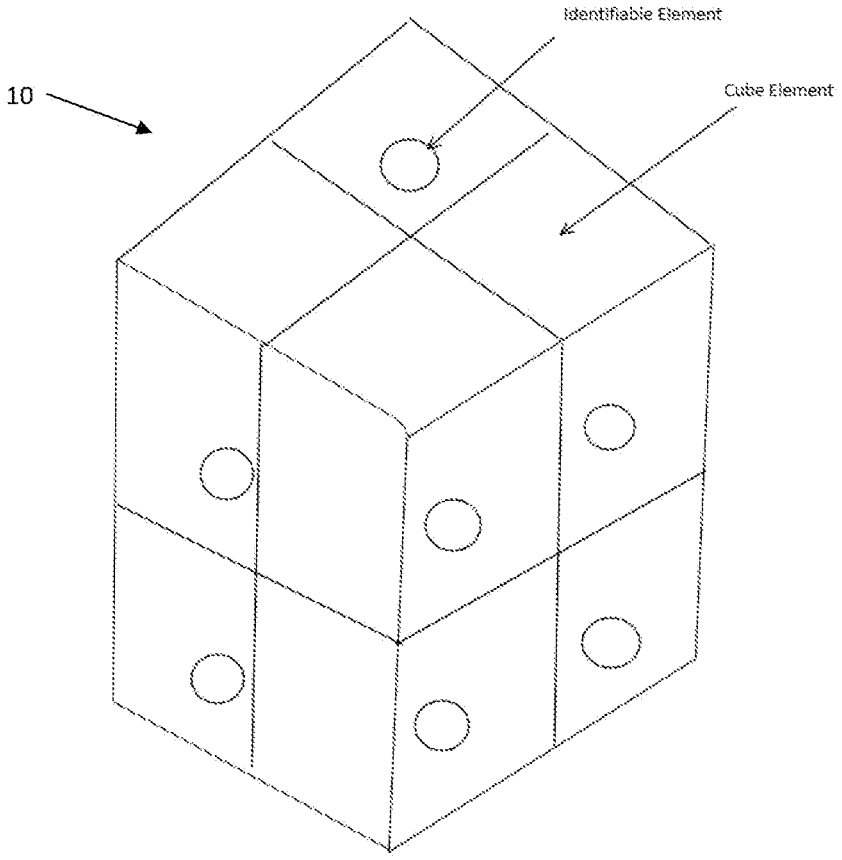
FIG. 5 illustrates the center block elements of a 3-dimensional 2×2 version of the Cube (without the side layers/side block elements) in accordance with an embodiment of the present invention.
Figure 6:
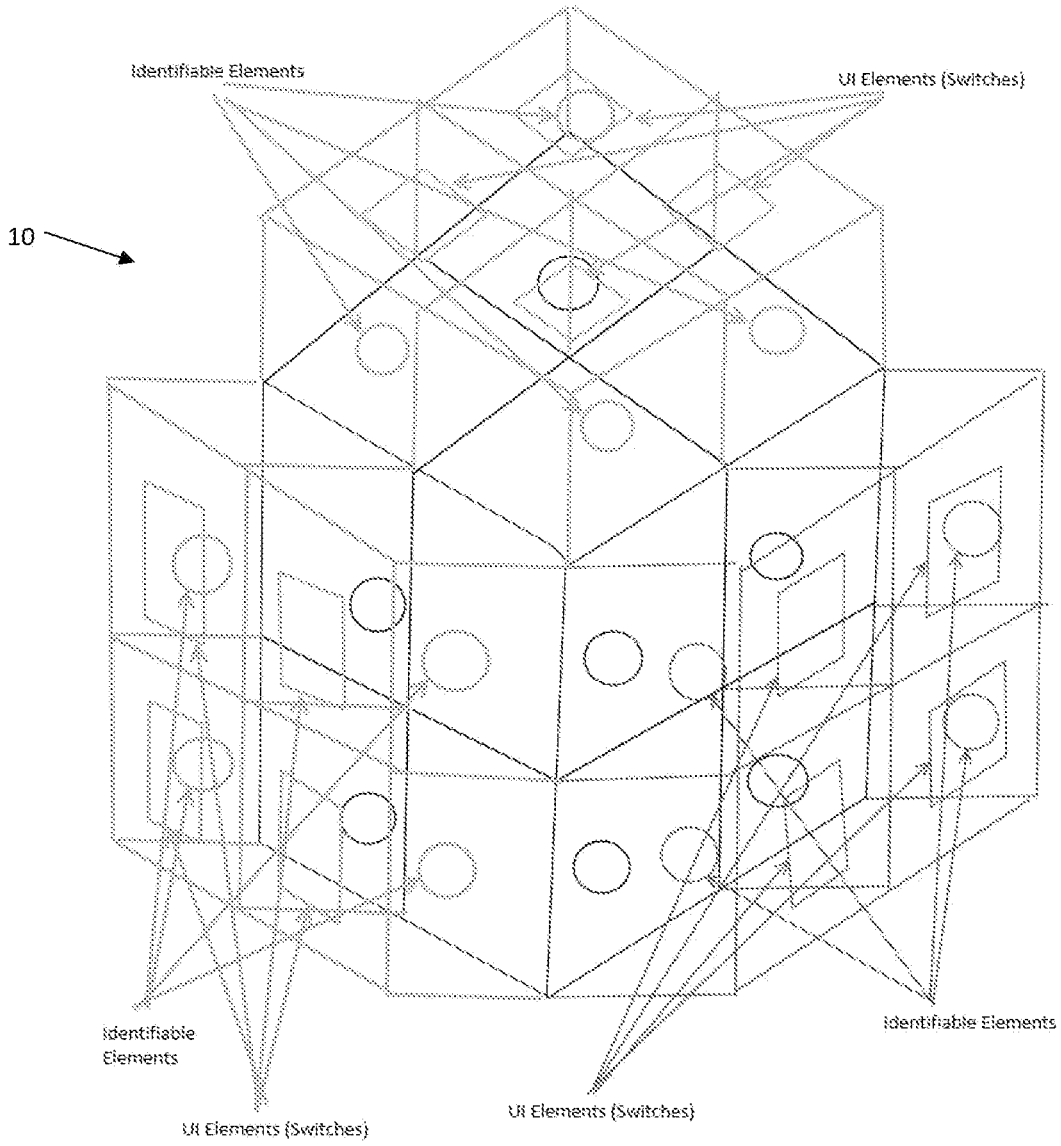
FIG. 6 illustrates a complete version of the same type of the Cube (with the side layers/side block elements) in accordance with an embodiment of the present invention.

FIG. 5 illustrates the center block elements of a 3-dimensional 2×2 version of the Cube (without the side layers/side elements), while FIG. 6 illustrates a complete version of the same type of the Cube (with the side layers/side elements).

The puzzle system 10 is solved when specific target patterns are achieved/matched (for example, when specific identifiable elements are located at each of the target locations). A full target pattern consists of a set of target locations as well as of a target identifiable element for each of the target locations.

The puzzle system 10 includes a physical cube system formed of any suitable size, shape, and design and is configured as the primary physical structure which a user interacts with during gameplay. The physical cube system includes a main body formed of any suitable size, shape, and design and is configured as the main body and/or main portion of the cube system and in this way houses and holds various components of the cube system.

In general, the main body includes a plurality of side elements, a first face extending a length from a first end to a second end between opposing sides, and having a plurality of cube portions and a plurality of identifiable elements, and a plurality of cube elements, and a plurality of switches, among other components, features, and functionality. Similarly, the main body includes a second face, a third face, a fourth face, a fifth face, and a sixth face.

The puzzle system is configured to provide movement with one identifiable element included within each connected elements, of which one identifiable element on one of the sides is always "empty", moving, after being activated via a user by a user interface element, from one side of the system towards the other side of the system.

The puzzle system 10 includes a graphical user interface gameplay system which includes, but is not limited to, two-dimensional puzzle engagement, virtual reality puzzle engagement, augmented reality puzzle engagement systems, and the like). The system 10 is operated by a plurality of users (also known as "player", or "plurality of players", or "individual", or "group of individuals", or "collaborators"). The user includes but is not limited to an individual person, a group of people, and/or an entity such as a business, an organization or the like.

The puzzle system 10 includes a hidden mode which is an advanced mode of the puzzle game wherein some of the identifiable elements are not visible during all or parts of gameplay and users memorize the position of identifiable elements in order to successfully pursue their strategies to reach a specific target pattern. The hidden mode is accomplished through game programming which does not display the colors of the hidden identifiable elements. The identifiable elements are hidden through off indicators and/or hiding indicators or as a result of the physical location of the hidden identifiable elements, which physically prevents the player from seeing certain parts of the puzzle system 10. In FIG. 4, the identifiable elements in the center of the puzzle are hidden.

The graphical user interface system includes a reset feature (or "reset on user request or after solution feature"). In the electronic version of puzzle game system 10, the target pattern is reset either based on an explicit request made by the user or after the puzzle game is solved and/or a target pattern is reached. A new target pattern is set when requested by the user or after the previous target pattern is achieved. In this way, system 10 provides for continuous game flow, so that a user can pursue a new target pattern immediately after achieving the previous target pattern. The graphical user interface system further includes a set of user defined targets formed of any suitable feature, function, size, shape, and design and are configured so that a user can input the target pattern. The user sets the target pattern via a suitable user interface mechanism. The user sets the target locations as well as the target identifiable elements that need to be moved to these target locations. The graphical user interface further includes a set of dynamic targets formed of any suitable feature, function, size, shape, and design and are configured such that the target pattern is dynamically modified based on game parameters and/or a predetermined set of rules within a memory and/or within the game programming. The target pattern may be modified if a certain number of moves and/or a certain amount of time is passed. If the user has not solved the game based on current targets within a predetermined parameter, the target pattern is modified so that the player adjusts strategy and/or the target pattern is modified in a way which is easier to achieve, or the like. The graphical user interface includes various viewing settings including but not limited to a full screen mode, a window mode, a close-up mode, and a wide screen mode, among other settings and functionalities.

The puzzle system 10 further includes an invitations feature. Invitations are formed of any suitable size, shape, and design and are configured to share information with a second person and/or group about engaging in gameplay. The invitation features include but is not limited to a messaging feature and/or voice feature for discussing strategy and interactions within the same game online or through other connected devices. The peer to peer linking includes but not limited to cloud and/or information streaming and/or sharing is utilized such that more than one person engages with system 10. The plurality of users in various remote locations compete, collaborate and engage with the same and/or different game board platforms as well as one another.

The puzzle system 10 comprises remote servers, databases, and/or computers that fulfill the functions disclosed and described herein. In the embodiment depicted, system 10 comprises at least one application server. Application server comprises one or more computer systems adapted to transmit and receive data regarding selected datasets related to various users and/or datasets related to multiple users adapted to a query database with unique identification codes to retrieve data information and/or parameters related to users, projects, items, textual responses, and more. Application servers transmit user data related to layers and rules with respect to a single user and/or multiple users and also adapted to query a user database. This query includes receiving and sending user identification codes and user data and/or textual responses. Additionally, the application server may communicate with a mobile application, which is adapted to present the user information in a form conducive to being viewed on a mobile device and/or handheld device.

As one of ordinary skill in the art may understand, application server, project database, and other databases mentioned herein is implemented in one or more servers. Furthermore, each of the multiple servers increase system efficiency, especially when handling large data gathering, data organizing, such as handling global positioning of a user, following extended rules for various functionality of system 10 and/or processing, updating user information, including various responses entered.

Additionally, system 10 includes a remote server, a computing system, includes an application programming interface ("API") which includes tools and resources enabling a user to operate the embodiments herein, and a cloud computing system. The system includes smart devices and/or system 10 includes computing systems. Computing system is formed of any suitable size, shape, and design and configured to handle computing operations, as are necessary for the operation of the computing functionality of system 10. Computing system may be connected with an electronic network and/or database and/or server or cloud via communication means and includes a processor, a memory, a microcontroller, a printed circuit board, a microprocessor, a receiver/transceiver, among other components. The computing devices are capable of displaying and manipulating data and includes for example a desktop computer, a laptop computer, a tablet, smart phone, or any other computing device or other interactive device. Computing devices includes a single consolidated component, or alternatively, computing devices are formed of a plurality of interconnected components that are co-located or located at different geographic locations. Computing devices are either cloud-based or hardware-based, or cloud capable. In addition, the connected components of computing devices include processor, memory, software and interactive user display, co-located with computing devices or located at different geographic locations. That is, computing devices are made of any form of a device or system that individually or collectively performs the computing operations of system 10. The system 10 includes a printed circuit board ("PCB") formed of any suitable size, shape and design and is configured to facilitate carrying and/or holding other components and/or parts necessary to carry out various computation and/or related functions of system 10. PCB, as one example, is either a surface mounted PCB or a through-hole PCB. PCB, as one example, is green and facilitates connecting the components and/or parts of system 10 by the use of traces and or vias. Traces are formed of any suitable size, shape and design and are configured as lines electrically connecting the components and/or parts of system 10. Vias are formed of any suitable size, shape and design and are configured as holes that connect layers of traces together. Generally, as in shown, traces and vias are soldered to connect the components and/or parts to the PCB. The puzzle system 10 is run by a microprocessor that receives and processes information and outputs commands according to instructions stored in memory. Memory is any form of information storage such as flash memory, RAM memory, a hard drive, or any other form of memory. Memory may be included as a part of or operably connected to a microprocessor. A receiver/transceiver is connected to a microprocessor. A receiver is used if one way communication is utilized, whereas a transceiver is used if two-way communication is utilized (hereinafter "transceiver"). The system 10 includes memory formed of any suitable size, shape and design and is configured to facilitate selective storage and retrieval of data (including data) in association with computing devices, processor, software and interactive user display. Memory may be a single component, such as a single chip or drive or other memory device, or alternatively memory may be formed of a plurality of memory or storage components that are connected to one another that may be co-located or located at different geographic locations.

Method of Use

A method of use of gameplay contains, on both sides, side elements that are associated with user interface elements which are activated and/or deactivated by a player. In this way, each set of connected elements is associated with the identifiable elements on each one of the sides of the set of connected elements, one of which always shows an "empty" state. An empty state, in this example, is represented by a light emitting diode that is switched off or by an empty slot. When a user activates a user interface element on any of the sides of the set of connected elements, the identifiable elements move through the set of the connected elements via the game programming predetermined rules that each of the connected elements moves by one element (or by one position). After this move is completed by the game programming, the identifiable element that previously showed empty now represents the element that was previously shown next to this element. For example, a user moves a represented element from first position to second position. In the example above, second position would be an empty position. First position is represented as red. First position is connected to second position, so that when a user activates first position, the red element is moved to second position. In this way, second position now shows red while first position changes to empty. Single occurrences, such as this example, or multiple occurrences happen affecting multiple positions when a user activates a single element. Said another way, and in another example, a sequence of four connected elements, which show the color sequence red, yellow, green and "empty", after the activation of these connected elements show the color sequence "empty", red, yellow and green. All colors are moved by one position and the "empty" position is now on the other side of the sequence of connected elements.

It will be appreciated by those skilled in the art that other various modifications could be made to the device without parting from the spirit and scope of this present invention (especially various programmable features). All such modifications and changes fall within the scope of the claims and are intended to be covered thereby.

The present invention provides systems and methods of use which provide a number of beneficial and entertaining gaming and/or puzzle activities for users of all ages. Various methods of use, further disclosed within, provide activities that aid in stimulating thought, logical skill development, creativity skill development, and may also aid in keeping minds and memories sharp and stimulated. This includes, but is not limited to mental maintenance and/or mental development, as well as the development and maintenance of fine motor skills and maintenance of these skills of users.

Therefore, the present invention provides systems and methods of use which may aid in the maintenance and development of creativity of various individuals, including but not limited to, aging citizens, and aging citizens who may have suffered trauma. Additionally, the present invention provides systems and methods of use that may reduce stress and/or anxiety levels in a variety of users and/or in users who may have suffered trauma and/or another occurrence.

The invention claimed is:

1. An interactive puzzle game system, comprising:

a plurality of connected elements;

a plurality of identifiable elements;

the plurality of connected elements is further divided into a plurality of center block elements and a plurality of side block elements;

the plurality of center block elements is enclosed by the plurality of side block elements;

the center block and the side block elements of the connected elements are associated with the identifiable elements, forming a set of associations between the connected elements and the identifiable elements;

a current game status defined by the current set of associations between the connected elements and the identifiable elements;

a plurality of interconnected chains of connected elements, wherein each chain of connected elements has one side block element on each of its sides and at least one center block element in the middle, wherein interconnections between the chains of connected elements occur at the center block elements and where for each chain of connected elements all center block elements are associated with identifiable elements and wherein for each current game status exactly one of the two side block elements is associated with an identifiable element;

each chain of connected elements is associated with a directed movement of the identifiable elements through the chain of connected elements in such a way that each identifiable element moves to a neighboring connected element in the direction from the side block that is associated with an identifiable element to the slide block that is not associated with an identifiable element;

the interactive puzzle game system is configured to operate based on a sequence of directed movements of identifiable elements along the chains of connected elements, resulting in a modified current game status, wherein the identifiable elements change their association with the connected elements as well as their association with specific chains of connected elements.

2. The interactive puzzle system as claimed in claim 1, wherein the puzzle game is solved based on matching of a target pattern by the corresponding identifiable elements from the plurality of the identifiable elements.

3. The interactive puzzle system as claimed in claim 1, wherein the target pattern consists of a plurality of target locations and a plurality of target identifiable elements associated with each of the target locations.

4. The interactive puzzle system as claimed in claim 3, wherein the variation of the plurality of the identifiable elements is based on change in colors of LEDs.

5. The interactive puzzle system as claimed in claim 1, wherein the plurality of identifiable elements is realized, without being limited to this, in the form of multi-color LEDs.

6. The interactive puzzle system as claimed in claim 1, wherein the directed movements are initiated by means of a plurality of user interface elements, wherein each of the side block elements is associated with one of the user interface elements and wherein the user interface elements include but are not limited to a plurality of switches and/or buttons.

7. The interactive puzzle system as claimed in claim 1, wherein the target pattern is modified based on whether the movement of the plurality of identifiable elements exceeds a threshold value at a predefined time.

8. The interactive puzzle system as claimed in claim 1, wherein the target pattern is set by a user.

9. The interactive puzzle system as claimed in claim 1, wherein the target pattern is set randomly.

10. The interactive puzzle system as claimed in claim 1, wherein the target pattern is reset based on user's input or under a specific condition.

11. The interactive puzzle system as claimed in claim 1, wherein the connected elements are arranged in a multi-dimensional array.

12. The interactive puzzle system as claimed in claim 1, wherein the shape of the connected elements includes but is not limited to a square, a hexagon, an octagon, a circle, a different polygon, or other shape or the like.

13. The interactive puzzle system as claimed in claim 1, wherein the puzzle system includes a main body formed of any suitable size, shape, and design.

14. The interactive puzzle system as claimed in claim 1, wherein at least one of the identifiable elements is temporarily or permanently hidden.

15. The interactive puzzle system as claimed in claim 1, wherein the interactive puzzle system operates in a variety of modes.

* * * * *